US007264244B1

(12) United States Patent
Moy

(10) Patent No.: US 7,264,244 B1
(45) Date of Patent: Sep. 4, 2007

(54) ACE TO KING SOLITAIRE

(76) Inventor: Edward Moy, 4140 Workman Mill Rd. #236, Whittier, CA (US) 90601

( * ) Notice: Subject to any disclaimer, the term of this patent is extended or adjusted under 35 U.S.C. 154(b) by 224 days.

(21) Appl. No.: 11/141,503

(22) Filed: May 31, 2005

Related U.S. Application Data

(60) Provisional application No. 60/669,234, filed on Apr. 6, 2005.

(51) Int. Cl.
*A63F 1/00* (2006.01)

(52) U.S. Cl. ..... 273/292; 273/274; 463/11

(58) Field of Classification Search ..... 273/292, 273/274, 309; 463/11, 12, 13
See application file for complete search history.

(56) References Cited

U.S. PATENT DOCUMENTS 5,653,635 A * 8/1997 Breeding ..... 463/11
5,711,715 A * 1/1998 Ringo et al. ..... 473/9
5,882,258 A 3/1999 Kelly et al.
6,077,161 A 6/2000 Wisler
6,179,291 B1 1/2001 Vancura

OTHER PUBLICATIONS

"Hit or Miss", Scarne's Encyclopedia of Games, John Scarne, Harper & Row Publishers, 1973, p. 391.*

* cited by examiner

*Primary Examiner*—Benjamin Layno

(57) ABSTRACT

A wagering card game between players and a dealer. Each player places a bet. A standard deck of 52 playing cards is shuffled and placed face down. The dealer checks the value of the top card and the bottom card of the deck. If the top card is not an ACE and if the bottom card is not a KING, the dealer commences the game by calling out card value names in the following sequence ACE, 2, 3, 4, 5, 6, 7, 8, 9, 10, JACK, QUEEN, KING while turning face up a card from the top of the deck after each card value name is called. If a currently upturned card matches the currently called out card value name, all players lose their bet. If all 52 cards are turned over without a single matching card value name being called out, then all players with their bet.

4 Claims, 1 Drawing Sheet

ACE TO KING SOLITAIRE

I. CROSS-REFERENCE TO RELATED APPLICATIONS

This application claims the benefit of U.S. Provisional Application No. 60/669,234 filed Apr. 6, 2005.

II. BACKGROUND OF THE INVENTION

The present invention is that of a new and improved gambling game using a deck of playing cards.

III. DESCRIPTION OF THE PRIOR ART

U.S. Pat. No. 6,179,291, issued to Vancura, discloses a casino wagering game and means for playing in which players goal is to not bust while accepting hits and includes a solitaire version.

U.S. Pat. No. 6,077,161, issued to Wisler, discloses means for playing a card game.

U.S. Pat. No. 5,882,258, issued to Kelly, discloses means for playing a card game.

IV. SUMMARY OF THE INVENTION

The present invention is that of a new and improved gambling game using a deck of playing cards. The game allows anywhere between one to seven players to play the game and allows each player to bet between $2.00 to $100.00 per round.

There has thus been outlined, rather broadly, the more important features of a card game that the detailed description thereof that follows may be better understood and in order that the present contribution to the art may be better appreciated. There are, of course, additional features of the card game that will be described hereinafter and which will form the subject matter of the claims appended hereto.

In this respect, before explaining at least one embodiment of the card game in detail, it is to be understood that the card game is not limited in its application to the details of construction and to the arrangements of the components set forth in the following description or illustrated in the drawings. The card game is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present card game. It is important, therefore, that the claims be regarded as including such equivalent constructions insofar as they do not depart from the spirit and scope of the present invention.

It is therefore an object of the present invention to provide a card game which has all of the advantages of the prior art and none of the disadvantages.

It is another object of the present invention to provide a card game which may be easily and efficiently manufactured and marketed.

It is another object of the present invention to provide a card game which is of durable and reliable construction.

It is yet another object of the present invention to provide a card game which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
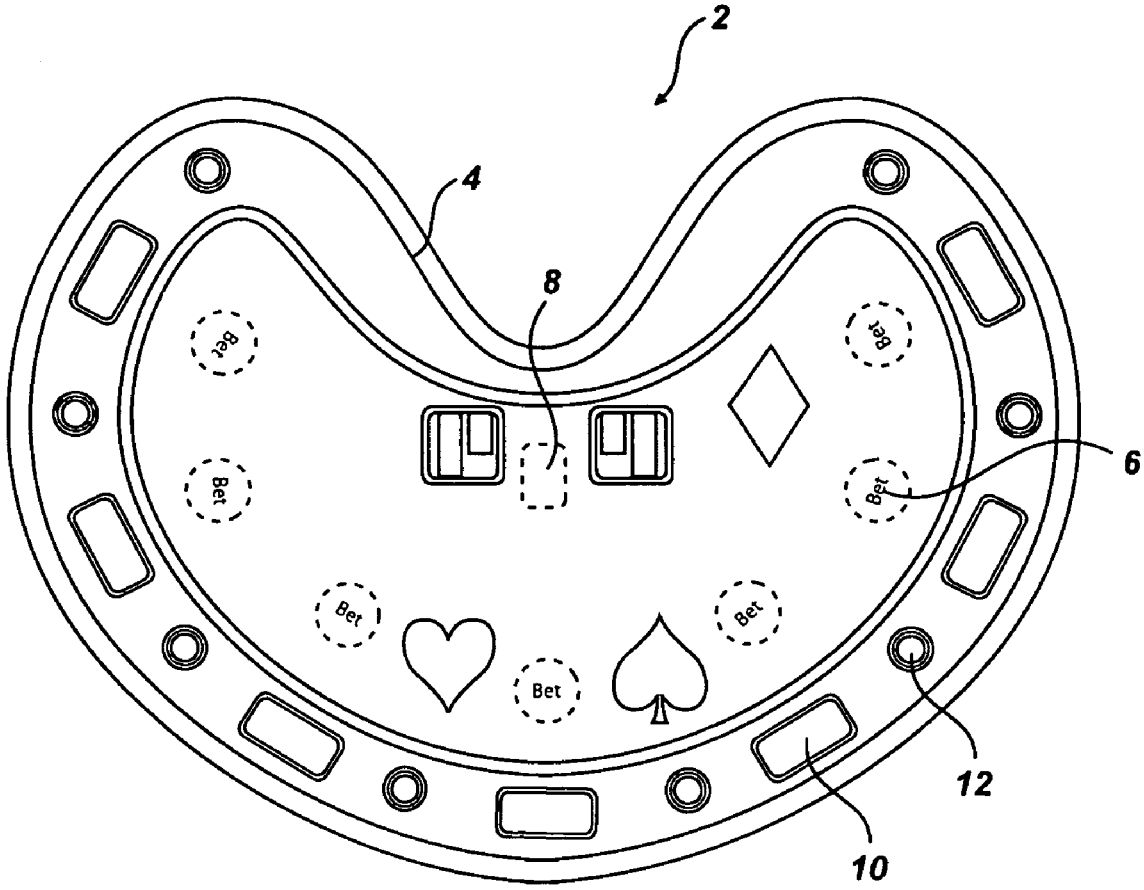
FIG. 1 shows a top representational view of a playing surface that could be used to play the gambling game of the present invention.

FIG. 1 shows a top representational view of a playing surface 4 that could be used to play the gambling game 2 of the present invention. The playing surface 4 comprises a plurality of betting circles 6, with this number of betting circles preferably numbering seven betting circles.

The playing surface 4 also has a card deposit area 8 in which the dealer places the deck of cards down, face up, one by one, while playing the game. Furthermore, a plurality of chip holding areas 10 and drink holders 12 are present to give players some convenience while playing the game.

Figure 2:
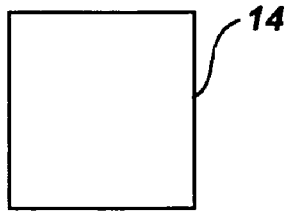
FIG. 2 shows a perspective view of a deck of cards that would be used with the gambling game of the present invention.

FIG. 2 shows a perspective view of a deck of cards 14 that would be used with the gambling game 2 of the present invention. The deck of cards 14 comprises 52 cards, which comprises four sets of cards that run from ace through king. No jokers are used in the deck of cards 14 for the gambling game 2 of the present invention.

To play this game, the following rules are to be applied:

1. Anywhere between 1-7 players can play each round of the game. Each player will place a bet in the betting circle 6 in front of him or her. Preferably, players may make a minimum bet of $2.00 and a maximum bet of $100.00 per round.
2. A deck of 52 cards is shuffled by the dealer. The dealer in turn asks each player if they wish to cut the deck. If a player agrees to this request, then the deck is cut and the dealer ceases all further offers to the remaining players to cut the deck.
3. The dealer then shows each of the players the top card and the bottom card of the deck. If the top card is an ACE or the bottom card is a KING, then all bets and wagers for that round are void and another round is started.
4. Once it is established that the top card is not an ACE and that the bottom card is not a KING, the dealer commences turning up the top card from the deck, one at a time, and starts calling out the following sequence: "ACE, 2, 3, 4, 5, 6, 7, 8, 9, 10, JACK, QUEEN, KING." Only one "card name" from the sequence is called each time a card is overturned.
5. If at any time the card being upturned is the same as the "card name" being called out by the dealer, all players lose their bet and a new round is started.
6. The actual suit of the cards do not matter in this game.
7. If all 52 cards are turned over without a single matching "card name" being called out when each card from the deck is overturned, then all players making a wager will win their wager at a 3:1 ratio.

I claim:

1. A method of playing a card game between a dealer and a plurality of players comprising the steps of:

(a) starting a round of the card game by receiving an initial bet from each player, (b) having the dealer shuffle a deck of cards, the deck of cards comprising a standard playing deck of cards of 52 cards, the deck of cards further comprising four sets of cards, each set having thirteen cards that run from a value of ACE to a value of KING, (c) having the dealer offer each player whether they want to cut the deck of cards until either each player refused the offer to cut the cards or until a player actually cuts the deck of cards, (d) having the dealer show the players the top card and the bottom card of the deck, (e) voiding the round and repeating the steps (a) through (d) if the top card of the deck is an ACE or if the bottom card is a KING, (f) placing the deck of cards face down, and the dealer proceeding by calling out a card value name while turning over, face up, the first top card from the deck, the dealer continuing calling out card value names according to a sequence of "ACE, 2, 3, 4, 5, 6, 7, 8, 9, 10, JACK, QUEEN, KING," while turning over, face up, the next top card from the deck after each card value name is called, (g) all players losing their bet if at any time during the calling out of card value names and the turning over cards from the deck, a currently turned over card has the same value as that of the card value name being currently called out by the dealer, (h) the dealer repeating the sequence of calling out the card value names while turning over cards from the deck until all players lose their bets in step (g) or until all 52 cards are turned over wherein all players win their bet if none of the 52 cards in the deck are turned over without a single matching card name being called out when each card from the card deck is overturned.

2. A method of playing a card game according to claim 1 wherein each player places their initial bet on a betting circle.

3. A method of playing a card game according to claim 2 wherein each player that wins their bet receives winnings at a 3:1 ratio.

4. A method of playing a card game according to claim 2 wherein each initial bet is between $2.00 and $100.00.

* * * * *